United States Patent [19]

Meade

[11] Patent Number: 4,610,364

[45] Date of Patent: Sep. 9, 1986

[54] CLOTHES DRYER LOWER CROSS ASSEMBLY

[75] Inventor: Ronald G. Meade, Edwardstown, Australia

[73] Assignee: Hills Industries Limited, Edwardstown, Australia

[21] Appl. No.: 674,542

[22] Filed: Nov. 26, 1984

[30] Foreign Application Priority Data

Nov. 24, 1983 [AU] Australia ..... PG2543

[51] Int. Cl.[4] ..... A47F 5/00

[52] U.S. Cl. ..... 211/183; 211/197; 135/37

[58] Field of Search ..... 211/197, 196, 183; 135/38, 41, 39, 37, 98, 28

[56] References Cited

U.S. PATENT DOCUMENTS

| | | | |
|---|---|---|---|
| 426,454 | 4/1890 | Ledig | 135/39 |
| 2,274,139 | 2/1942 | Goldthwait et al. | 211/197 |
| 3,724,473 | 4/1973 | Moss | 135/98 X |
| 4,047,616 | 9/1977 | Seabrook | 211/183 |

FOREIGN PATENT DOCUMENTS 1354482 5/1974 United Kingdom .

*Primary Examiner*—Ramon S. Britts
*Assistant Examiner*—Blair M. Johnson
*Attorney, Agent, or Firm*—Henry Sternberg; Bert J. Lewen

[57] ABSTRACT

A lower cross assembly of an elevating clothes dryer which has a lower cross slidable over a stem, the lower cross having a plurality of pairs of outwardly radiating lugs, the lugs of each pair retaining between them a respective pin about which a clothes dryer arm is pivotal, and a closure cap releasably retained to the lower cross and retaining said pins in their lugs.

6 Claims, 5 Drawing Figures

CLOTHES DRYER LOWER CROSS ASSEMBLY

This invention relates to improvements in a clothes dryer lower cross assembly of the type generally described and illustrated in the specification of Applicant's Australian Pat. No. 499,094 entitled "Clothes Dryer Latch". (Corresponding overseas patents are: U.S. Pat. No. 4,047,616, UK No. 1,529,018 and NZ No. 180,271).

BACKGROUND OF THE INVENTION

In that specification there was claimed, in combination, a clothes dryer of the type wherein an upper stem portion was slidable within a lower stem portion, and slidable over at least one portion was a bush having a series of arms pivoted thereto and radiating therefrom, the arms being movable from a retracted position with the bush in a downward location to an extended operative position with the bush in a relatively upward location, and a latch releasably retained in its upper location. The latch comprised a latching body on one of the members and the striker plate co-operable therewith on the other of the members, and the striker plate had a sliding surface spaced from the standard but facing the standard and a latching surface extending away from the sliding surface and away from the standard. The latching body was provided with a latching tongue with a ramp face which slid over the sliding surface upon upward movement of the bush, and the latching body terminated in a shoulder engageable with the latching surface of the striker plate and arranged to retain the bush and standard against relative movement when the bush was in its relative upward location the tongue being of resilient material deformable towards the standard and thereby away from the striker plate to effect release of the bush from the standard. The reader's attention is drawn to the contents of that specification, which are referred to herein only by way of explanation.

That invention has proven to be technically and commercially successful, and the invention herein relates to improvements wherein all the abovementioned elements are present, but has as its main object the provision of improvements, both of a mechanical nature, and in aesthetics.

The inner ends of the radiating arms of a clothes dryer or hoist of the above described type are provided with hinge means which, for maintenance purposes, should be readily removable and replaceable. The hinge means are not aesthetically pleasing in most instances, and a further object of this invention is to provide retention means which is readily removable from its operative position for maintenance purposes, but which functions to retain the hinge means in position so that maintenance can be facilitated, and at the same time the appearance can be markedly improved.

BRIEF SUMMARY OF THE INVENTION

In one embodiment of this invention a lower cross assembly of an elevating clothes dryer has a lower cross slidable over a stem, the lower cross having a plurality of pairs of outwardly radiating lugs, the lugs of each pair retaining between them a respective pin about which a clothes dryer arm is pivotal, and a closure cap releasably retained to the lower cross and retaining said pins in their lugs.

More specifically, the invention consists of a clothes dryer lower cross assembly for an elevating clothes dryer of the type having arms which radiate from a lower cross itself slidable over a stem, said arms being guided by stays pivoted at their upper ends to an upper cross and at their lower ends to respective said arms intermediate the ends thereof, said lower cross having a plurality of outwardly radiating pairs of lugs, the lugs of each pair being parallel and retaining between them a respective pin about which a respective one of said arms is pivotal, a cover having walls which lie contiguous with the outer surfaces of said lugs and thereby retain said pins therein, and retention means releasably retaining the cover and lower cross.

BRIEF DESCRIPTION OF DRAWINGS

An embodiment of the invention is described hereunder in some detail with reference to and as illustrated in the accompanying drawings in which.

DETAILED DESCRIPTION OF THE PREFERRED EMBODIMENT

Figure 1:
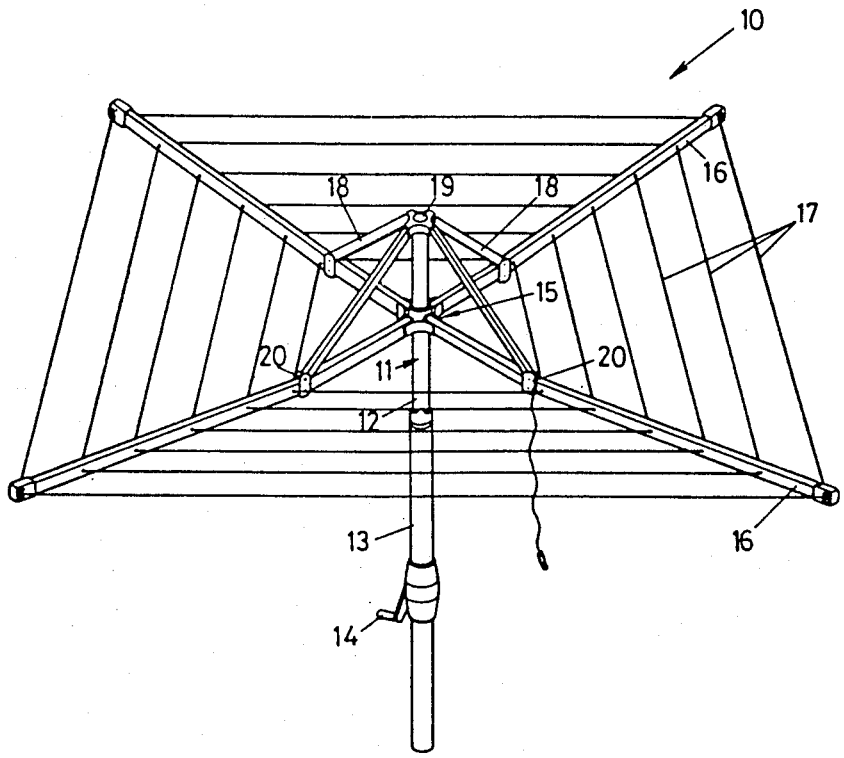
FIG. 1 is a perspective view of an elevating clothes dryer.

As shown in FIG. 1, an elevating clothes dryer 10 is of the type wherein a stem 11 comprises an upper stem portion 12, being elevated by a handle 14 carried on the lower stem portion 13. A lower cross 15 has a plurality of arms 16 radiating therefrom, the arms 16 supporting between them clothes dryer lines 17. A plurality of stays 18 extend from an upper cross 19 to which their upper ends are pivoted and these are pivoted at their lower ends to brackets 20 carried on the arms 16 intermediate the ends of those arms.

The above description is appropriate for clothes dryers of the type to which this invention was applied.

Figure 2:
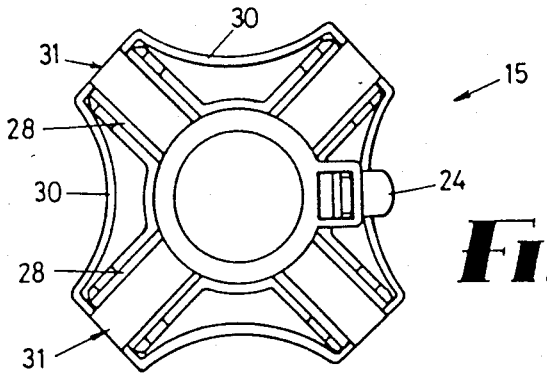
FIG. 2 is a top view of a lower cross assembly.

Referring now more specifically to FIGS. 2 through to 5, the lower cross 15 forms part of an assembly which also comprises a striker plate sleeve 23, a latching body 24, a bearing bush 25 and a cover 26.

Figure 5:
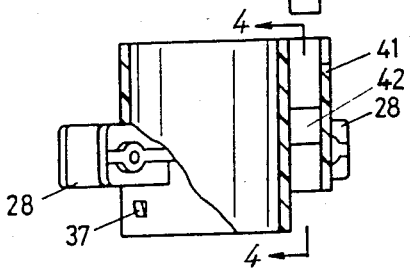
FIG. 5 is a fragmentary section drawn to an enlarged scale showing the cover obscuring a hinge pin and retaining it between a pair of lugs.
Figure 5:
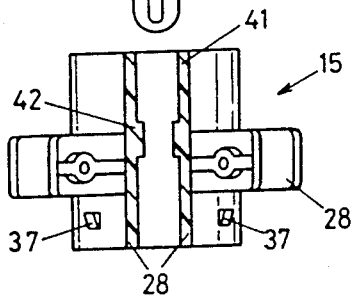
Figure 5:
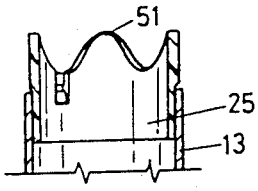
Figure 5:
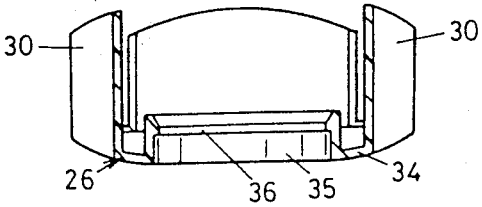
Figure 5:
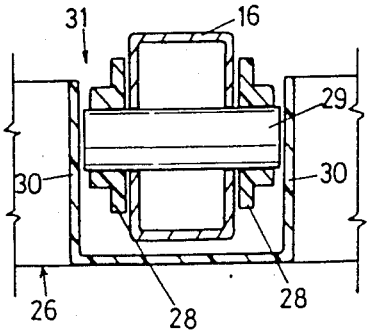

The lower cross 15 is provided with a plurality of outwardly radiating pairs of lugs 28, the lugs of each pair being parallel and retaining between them a respective pin 29 (FIG.5), about which a respective one of the arms 16 is pivotal.

Figure 3:
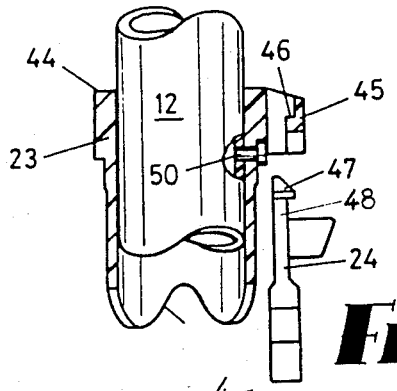
FIG. 3 is a partly sectioned "exploded" view of the elements of that assembly.

As seen best in FIG. 3, the cover 26 is provided with side walls 30 which lie contiguous with the ends of the pin 29 and prevent axial displacement thereof. Between the side walls 30 there are adjacent edges defining therebetween arm access slots 31 within which the inner ends of the arms 16 are freely movable.

The cover 26 also has a lower end portion 34 with a central upwardly directed flange 35 having an inwardly facing annular latch ring 36, and the lower cross comprises four latching barbs 37 which engage the ring 36 when the cover is urged upwardly to releasably retain the cover to the lower cross 15. Release of the cover is achieved by resilient deformation of the flange 35.

Figure 4:
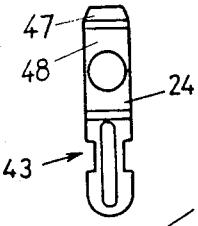
FIG. 4 is a part end elevation of FIG. 3, sectioned on line 4—4 of FIG. 3.

As seen best in FIGS. 3 and 4, the outer wall of the lower cross 15 has receptacle walls 41 extending outwardly therefrom, these receptacle walls 41 having inwardly facing projections 42 intermediate their ends, and the receptacle retains the latching body 24 which has complementary recesses 43 which accommodate the projections 42.

The striker plate sleeve 23 has a flange 44 at its upper end, and this flange 44 has walls extending outwardly defining a striker plate 45 having a latching surface 46 which engages a latch 47 on the upper end of a tongue 48 of the latching body 24.

In other respects the elements are similar to those described in said Australian Patent 499,094, the striker plate sleeve 23 being retained to upper stem portion 12 by means of a pin 50, and the lower cross 15 is slidable over the outer surface of sleeve 23. It is also slidable over the outer surface of the bearing bush 25, and the lower stem portion 13. The upper end of the bearing bush 25 terminates in a wave shaped edge 51 which co-operates with a similarly shaped edge 52 on the lower end of sleeve 23 to snub rotational movement of the rotary portion of the clothes dryer.

It has been found in practice that the improvements in this invention result in simpler construction and improved and safer operation, than could be achieved with our earlier design.

I claim:

1. Clothes dryer lower cross assembly for an elevating clothes dryer of the type having arms which radiate from a lower cross itself slidable over a stem, said arms being guided by stays pivoted at their upper ends to an upper cross and at their lower ends to respective said arms intermediate the ends thereof, said lower cross having a plurality of outwardly radiating pairs of lugs, the lugs of each pair being parallel and retaining between them a respective pin about which a respective one of said arms is pivotal, a cover having side walls which extend from an end portion and which lie contiguous with the outer surfaces of said lugs and the ends of said pins to thereby retain said pins in their respective said lugs and said cover having a plurality of openings respectively in registry with the space defined between each said pair of lugs, each said opening being adapted to allow the corresponding one of said arms to extend therethrough for pivoting of said arms about the respective pins, and retention means releasably retaining the cover to the lower cross.

2. Clothes dryer lower cross assembly according to claim 1 wherein said end portion is the lower end portion of said cover and said cover walls include four side walls extending upwardly from the perimeter of that lower end portion, each side wall terminating in an upwardly extending edge, adjacent edges defining therebetween arm access slots through which respective said arms extend, and said retention means comprising co-operable latch means on the cover and on the lower cross.

3. Clothes dryer lower cross assembly according to claim 2 wherein said cover lower end portion comprises a central upwardly directed flange having an inwardly facing latch ring, and said lower cross comprises at least one latching barb outstanding from its outer surface which latches said latching ring upon assembly of said cover to said lower cross, said flange being capable of sufficient resilient deformation to release said barbs from said latching ring.

4. Clothes dryer lower cross assembly according to claim 1 further comprising a striker plate sleeve having a flange at its upper end and a sleeve depending therefrom, and a striker plate located radially outwardly of the sleeve and having a latching surface, said lower cross having upwardly extending walls defining a receptacle, a latching body within the receptacle having surfaces which engage and are retained by retaining surfaces within the receptacle, said latching body comprising a latching tongue projecting upwardly from the receptacle and being engageable with said striker plate latching surface, but being resilient to thereby be releasable from that latching surface.

5. Clothes dryer lower cross assembly according to claim 4 wherein the clothes dryer is of the type wherein said standard comprises a lower standard portion and an upper standard portion telescopically slidable therein, further comprising a bearing bush positionable in the upper end of the lower standard portion, said striker plate sleeve being positionable over the upper standard portion, and said lower cross having an inner surface of such diameter that it is freely slidable over both said striker plate sleeve and said bearing bush.

6. Clothes dryer lower cross assembly for an elevating clothes dryer of the type having arms which radiate from a lower cross itself slidable over a stem, said arms being guided by stays pivoted at their upper ends to an upper cross and at their lower ends to respective said arms intermediate the ends thereof, said lower cross having a plurality of outwardly radiating pairs of lugs, the lugs of each pair being parallel and retaining between them a respective pin about which a respective one of said arms is pivotal, a cover having walls which lie contiguous with the outer surfaces of said lugs and thereby retain said pins therein, adjacent ones of said walls defining therebetween arm access slots forming openings in registry with corresponding pairs of said lugs to allow the corresponding one of said arms to extend therethrough for pivoting of said arms about the respective pins, and retention means releasably retaining the cover to the lower cross.

* * * * *